United States Patent [19]

Tackles

[11] Patent Number: 4,828,128

[45] Date of Patent: May 9, 1989

[54] CAP FOR MOTOR OIL CONTAINER

[75] Inventor: George Tackles, San Jose, Calif.

[73] Assignee: Cap Snap Co., San Jose, Calif.

[21] Appl. No.: 191,128

[22] Filed: May 6, 1988

[51] Int. Cl.[4] ..... B65D 41/48

[52] U.S. Cl. ..... 215/256

[58] Field of Search ..... 215/31, 256, 321

[56] References Cited

U.S. PATENT DOCUMENTS

| | | | |
|---|---|---|---|
| 2,463,701 | 3/1949 | Krueger | 215/321 |
| 3,073,472 | 1/1963 | Williams | 215/256 |
| 3,499,567 | 3/1970 | Spotts | 215/31 |
| 3,696,957 | 10/1972 | Van Baarn | 215/321 X |
| 3,940,004 | 2/1976 | Faulstich | 215/256 |
| 4,066,181 | 1/1978 | Robinson | 215/256 |
| 4,071,156 | 1/1978 | Lowe | 215/256 X |
| 4,202,455 | 5/1980 | Faulstich | 215/31 |
| 4,307,821 | 12/1981 | McIntosh | 215/256 X |
| 4,438,857 | 3/1984 | Bullock | 215/256 |
| 4,531,650 | 7/1985 | Friendship | 215/256 |
| 4,561,553 | 12/1985 | Crisci | 215/256 |
| 4,566,601 | 1/1986 | Kuenzig | 215/256 X |
| 4,589,561 | 5/1986 | Crisci | 215/256 |
| 4,667,839 | 5/1987 | Crisci | 215/256 |
| 4,700,860 | 10/1987 | Li | 215/256 |
| 4,729,488 | 3/1988 | Bullock | 215/256 |

FOREIGN PATENT DOCUMENTS

| | | | |
|---|---|---|---|
| 954475 | 9/1974 | Canada . | |
| 1137029 | 6/1982 | Canada | 215/256 |
| 1393366 | 2/1965 | France | 215/256 |

*Primary Examiner*—Donald F. Norton

*Attorney, Agent, or Firm*—Julian Caplan

[57] ABSTRACT

The neck of a plastic container for motor oil or similar thin fluids is formed wiht plural, discrete, smooth external conical surfaces and further formed with shoulders below each such surface. The cap for such neck has an interior generally complementary to the exterior of the neck. Internal cap beads engage under the shoulders of the neck. At least the lowermost cap shoulder is preferably interrupted. Above each bead is an internal circumferential rib which seals against the corresponding smooth conical surface of the neck. The lower portion of the cap including the lowermost bead may be torn away, permitting the upper part of the cap, which functions as a reclosure cap, to be pried off the neck. For such purpose, the cap wall is made thin below the second locking bead and a downward-slanted scoreline extends from the thin area to the bottom edge of the cap. A tear tab extends below the bottom edge of the cap adjacent the terminals of the score line. Standoffs space the tab from the neck for ease in gripping the tab.

26 Claims, 1 Drawing Sheet

CAP FOR MOTOR OIL CONTAINER

BACKGROUND OF THE INVENTION

1. Field of the Invention

This invention relates to a new and improved plastic snap-on type tamper-evident cap and to the neck construction for a container for motor oil or the like closed by such cap.

2. Description of Related Art

Heretofore, motor oil containerrs have been closed by high density polyethylene screw caps by reason of the fact that the product tends to leak through conventional closures. The present invention uses a snap-on cap. Although snap-on caps have been used for such purpose, the structure of such caps is considerably different.

Tamper-evident caps wherein the skirt of the cap is weakened by score lines so that the lower portion of the skirt may be torn away before the cap is removed are well known in the art. Such caps are formed with internal beads which lock under shoulders on the exterior of the container neck. When the lower portion of the skirt is torn away, the remaining (reclosure) portion of the cap may be removed, but when the skirt is intact, the cap cannot be removed without evidence of tampering with the contents appearing.

Interrupted internal cap beads are also known in the art, such beads permitting flexure of the cap skirt so that the container neck is not crushed nor is the cap split.

One conventional means for removing the lower portion of the cap skirt has been formation of a line of minimum or reduced thickness in the wall of the skirt which extends horizontally around the skirt and a depending scoreline extending to the bottom of the skirt, the tear tab being located near the lower end of the depending score line. By pulling the tear tab the skirt tears along the downward-extending tear line and then circumferentially around the horizontal line of reduced thickness. The configuration of the line of minimum thickness comprises a novel feature of the present invention.

To facilitate gripping the tear tab, the lower end of the skirt has been offset in the region thereof so that the tear tab may conveniently be gripped by the thumb or finger of the user.

SUMMARY OF THE INVENTION

The present invention is used with containers for motor oil and other liquids which tend to leak through ordinary closures. Since the interior surfaces of such necks are irregular, and further since the upper edge or lip of the neck is frequently irregular, the present invention uses exterior surfaces of the neck as sealing surfaces. Accordingly, in accordance with the present invention, the neck has three or more downwardly-outwardly slanted smooth external sealing surfaces. Preferably such surfaces are of gradually increasing diameter proceeding downwardly.

A feature of the invention is that the exterior of the neck, particularly the uppermost surfaces thereof, are machined to remove flash and to make the surfaces more nearly round. Thus the cap may more effectively seal against such surfaces.

The interior of the cap is formed complementary to the neck particularly to the upper slanted smooth external sealing surfaces. The interior of the cap may also be formed with anti-capillary ribs which engage the sealing surfaces of the neck.

The neck of the container has shoulders formed below the slanted sealing surfaces and the cap has internal beads which lock under such shoulders. In accordance with the present invention there are at least three beads formed on the interior of the cap. Two of these beads are formed on the upper portion of the cap, which is as a reclosure cap. The use of two retaining beads and three ribs insures that leakage from the container after the lower portion of the skirt (which contains the third locking bead) has been torn away does not occur.

In accordance with this invention, one of the external locking bead of the neck may be interrupted, preferably the lowest such bead. The lowermost internal cap bead may also be interrupted.

Another feature of the invention is the provision of an offset between the interior of the lower portion of the skirt and the exterior of the neck in the region adjacent the tear tab used to tear off the lower portion of the skirt. This offset facilitates the thumb or finger of the user gripping the tear tab.

Standoffs are formed in the interior of the cap at the offset portion to insure the offset remains in proper position. The standoffs also deter efforts to defeat the tamper-evident feature by blocking insertion of a prying instrument under the skirt in the region of the offset.

The provision of the offset above the horizontal line of reduced thickness leaves a lift tab after the lower portion of the skirt has been torn off. The user may pry the lift tab upward to snap the reclosure cap off the neck.

A feature of the invention is that the line of minimum thickness slants upward-outward. Thus the torn lower edge of the reclosure cap appears less frayed and thus aesthetically improved.

Still another feature of the invention is the fact that the exterior and the interior of the caps are dimensioned so that during transportation and storage the caps do not nest and hence feeding of caps through a capping machine is not inhibited.

Other objects of the present invention will become apparent upon reading the following specification and referring to the accompanying drawings in which similar characters of reference represent corresponding parts in each of the several views.

IN THE DRAWINGS

DESCRIPTION OF PREFERRED EMBODIMENTS

Figure 1:
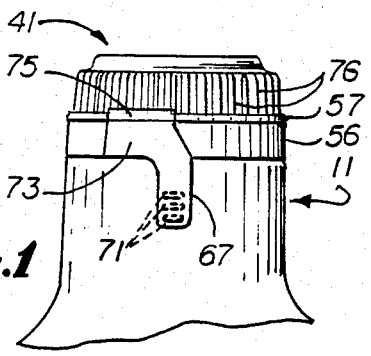
FIG. 1 is a side elevational view of the open portion of the neck of the container and the cap assembled thereon.

Neck 11 of the container with which the present invention is used has a top edge or lip 12. The container is of a blow-molded plastic construction and it is typical of such constructions that the top edge 12, as well as the interior, are irregular in dimension and sometimes rough. Accordingly, the present container neck 11 employs external sealing surfaces. Thus after the container has been molded it is preferably machined so that flash is removed from surface 12 and also the top external surface 13. Further, these surfaces are made more nearly round as a result of such machining. This machining is readily done in large-scale production. The round, smooth surfaces are readily sealed by ribs on the inside of the cap, as hereinafter appears.

Figure 2:
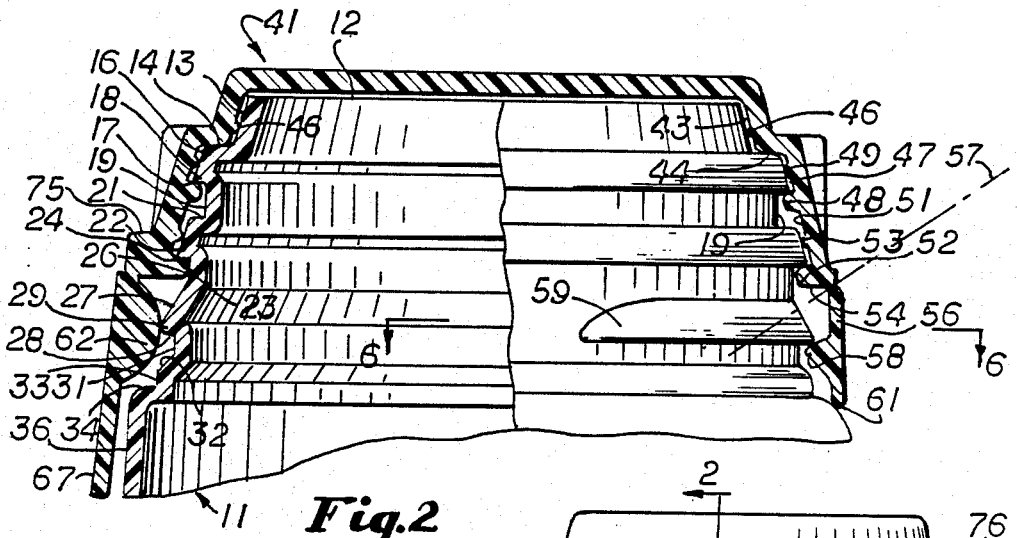
FIG. 2 is an enlarged view taken substantially along the line 2—2 of FIG. 1 showing on one-half of the view the exterior of the container neck and on the other half of the view a section through the neck.

Directing attention now to FIG. 2, proceeding downward from top edge 12, there is a first, or top, slanted surface 13 disposed at an angle of approximately 80° to the horizontal which terminates in a first horizontal outer shoulder 14. Below shoulder 14 is a second slanted surface 16 which is disposed at an angle of approximately 65° to the horizontal which terminates in first horizontal inward-extending shoulder 17. The angle where surfaces 16 and 17 join comprises first or top external bead 18.

Below shoulder 17 is first vertical surface 19 which terminates in a second horizontal outer shoulder 21. Third slanted surface 22 (disposed at an angle of approximately 65° to the horizontal) extends downward from surface 21 and terminates in second horizontal inward-directed shoulder 23. Thus, surfaces 22 and 23 define the second external bead 24. Below shoulder 23 is second vertical surface 26 which terminates in a fourth downward-outward slanted surface 27 disposed at an angle of approximately 55° to the horizontal. In normal usage, the surface 27 does not comprise a sealing surface. Below surface 27 is third horizontal inward-directed shoulder 28. The surfaces 27 and 28 define the third external locking bead 29.

Below surface 28 is third vertical surface 31 which terminates in an outward-downward slanted surface 32 disposed at an angle of approximately 45° to the horizontal. At the outer edge of surface 32 is a short vertical surface 33 which terminates in an outward directed horizontal shoulder or ledge 34. Below surface 34 is the remainder 36 of the neck 11, the details of which form no part of the present invention.

It will be noted that the interior of the neck 11 generally conforms to the exterior so that the wall thickness is approximately uniform throughout.

Directing attention now to cap 41, top disk 42 on its underside has a diameter slightly greater than the diameter of lip 12. Describing now the interior of cap 41, depending from disk 42 is first slanted surface 43, which terminates in an outward directed horizontal shoulder 44. Surface 43 is parallel to and may seal against surface 13. However, as shown, an internal first rib 46 is directed to bear against and seal with surface 13. Joining the outer edge of horizontal surface 44 is second downward-outward slanted internal surface 47 which seals against surface 16 and which terminates in an internal locking bead 48, which locks under the top bead 18. Approximately midway along the surface 47 is second internal rib 49 which seals against slanted surface 16.

Below bead 48 is third downward-outward slanted surface 51 which seals against surface 22 and which terminates in second internal locking bead 52 which locks under the second shoulder 21. Third internal rib 53 seals against third slanted surface 22. Below bead 52 is outward-directed horizontal surface 54. On the exterior of the cap, slightly above the elevation of surface 54 is an external shoulder formed so that the line of minimum thickness 57 slants downward-inward. When lower skirt portion 56 is torn away (as hereinafter explained) the lower edge of the reclosure cap (FIG. 4) the lower edge thereof is aesthetically improved because it slants downward-inward.

Figure 4:
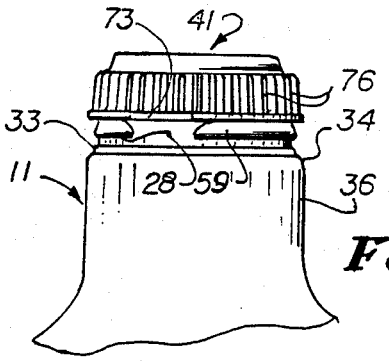
FIG. 4 is a view similar to FIG. 1 with the lower portion of the skirt torn away.

Third internal locking bead 58 is positioned to engage under bead 29. As best shown in FIGS. 2 and 4, bead 29 of neck 11 is interrupted and is formed in two sections 59. Bead 58 is also interrupted and formed in sections 60. The alignment of sections 59 and 60 may be random. If the container is non-circular and tab 67 is oriented by the capping machine chute, sections 59 and 60 may be controlled to overlap. This permits the cap 41 to snap onto the neck 11 without likelihood of crushing the neck or splitting the cap.

The bottom edge 61 of lower skirt 56 is positioned to rest on the ledge 34 when the cap is seated on the neck.

Depending from line of minimum thickness 57 is a slanted tear line 66 formed on the exterior of lower skirt 56 which extends down to the lower edge 61. Adjacent the terminus of line 66 is a depending tear tab 67. The corner 68, where one edge of the tab 67 joins the edge 61 adjacent the slanted tear line 66, is square, whereas on the opposite edge of the tab 67, there is a rounded corner 69. This structure reduces the possibility that tab 67 may be torn off without the lower portion of the cap skirt being removed. Formed on the interior of the tear tab 67 are gripping ribs 71.

An optional feature of the invention is the formation of an offset portion 73 of the lower skirt 56 between the slanted score line 66 and a substantially vertical line 74. Standoffs 62 formed on the interior of lower skirt 56 between lines 66 and 74 cause the offset 73 to be spaced outward of the neck 11, thereby facilitating the finger or thumb of the user gripping the tear tab and the ribs 71. Standoffs 62 also prevent a prying instrument under the offset 73. Accordingly the user pulls the tab 67 upward, causing the skirt to tear along the score line 66 upward from corner 68 to line 57. Continued pulling on the tab 67 causes the cap 41 to tear along line 57. Thereby the lower skirt portion 56 and the locking bead 58 are torn away. As shown in FIG. 7, the line of minimum thickness slants downward-inward. Thus the bottom edge of the reclosure cap above line 57 appears smooth, rather than frayed.

Figure 5:
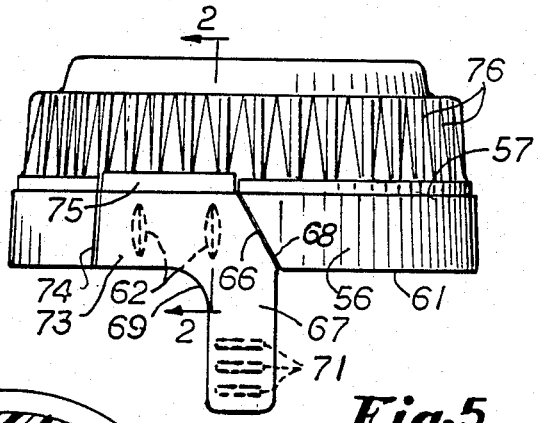
FIG. 5 is an enlarged side elevational view of the cap.
Figure 6:
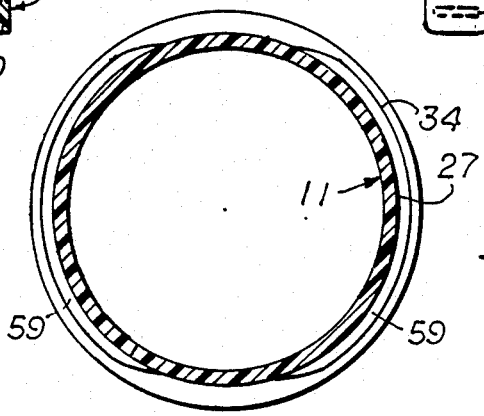
FIG. 6 is a sectional view taken substantially along line 6—6 of FIG. 2.

The portion of the cap above line 57 constitutes a reclosure cap (see FIG. 5) held in place by the beads 48 and 52 locking under the beads 15 and 24, respectively. When the lower portion 56 of the skirt is intact, the additional bead 58 prevents the cap from being removed from the container neck. If attempts are made to remove the cap in order to tamper with the contents of the container, the skirt tears along the line 57, providing evidence of tampering.

Lift tab 75 is part of offset 73 above line 57. Tab 75 may be used to pry off the reclosure cap (see FIG. 4) after the lower portion of the skirt has been torn off.

The exterior of the cap 41 generally follows the interior thereof so that it is of substantially uniform thickness. However, to facilitate gripping the cap, external vertical ribs 76 may be formed exteriorly of the surfaces 47 and 51.

Figure 3:
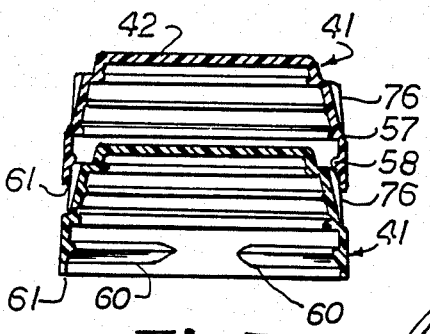
FIG. 3 is a sectional view through two caps showing how they resist tight nesting.

During transportation and storage of the caps, as best shown in FIG. 3, it is desirable that the caps not nest tightly. The upper ends of the ribs 76 fit against the lower surface of bead 58. Thus the lower cap cannot fully nest in the upper.

In the claims, terminology somewhat inconsistent with the terms used in the foregoing specification have been employed:

Top external surface 13 is referred to as upward-inward slanted external surface, second slanted surface 16 as first, external (downward-outward) slanted surface, first inward-extend shoulder 17 as first horizontal inward-directed shoulder, third slanted surface 22 as second external downward-outward slanted surface, fourth downward-outward slanted surface 27 as third external slanted surface, first slanted surface 43 as upward-inward slanted internal surface, internal first rib 46 as upward-inward slanted internal surface, second downward-outward slanted internal surface 47 as first internal downward-outward slanted surface, internal locking bead 48 as first internal bead means, second internal rib 49 as circumferential internal rib third downward-outward slanted surface 51 as second internal downward-outward slanted surface, second internal locking bead 52 as second internal bead means, and third internal locking bead 58 as third bead means.

What is claimed is:

1. In combination a container neck having a lip 12, at least a first external, downward-outward slanted surface 16 and at least a first 17 and a second 23 horizontal inward-directed shoulder below said first slanted surface; and a cap having a top disk 42 overlying said lip and having a downward-outward slanted skirt depending from said disk, said skirt having an internal shape generally complementary to the exterior of said neck, said skirt having a first internal downward-outward slanted surface 47 opposite said first external downward-outward slanted surface and first 48 and second 52 internal bead means positioned to lock under said first and second shoulders of said neck to hold said cap on said neck, said skirt being formed with tear means 67 to tear off the lower portion of said skirt below said second bead means.

2. The combination of claim 1 in which said neck is formed so that the bottom edge 61 of said cap rests on a third horizontal shoulder 34 on the neck.

3. The combination of claim 1 in which said neck is formed above said inward-directed shoulder 17 with an upward-inward slanted external surface 13 and the interior of said cap is formed above said first internal bead means with an upward-inward slanted internal surface 46 sealing against said last-mentioned slanted external surface.

4. The combination of claim 3 in which said neck is formed with a second external downward-outward slanted surface 22 positioned below said first inward-directed shoulder 17, said second horizontal inward-directed shoulder 23 being below said second external slanted surface 22, a third external slanted surface 27 below said second external slanted surface 22 and said second horizontal inward-directed shoulder 23 and a third horizontal inward-directed shoulder 28 below said third external slanted surface 27, and said skirt has a third bead means 58 positioned to lock under said third shoulder 28 of said neck and is further formed with a second internal downward-outward slanted surface 51 sealing against said second external slanted surface 22.

5. The combination according to claim 4 in which at least one said neck bead is interrupted.

6. The combination according to claim 1 in which said tear means comprises a first horizontal line 57 of reduced thickness above said third bead means 58, a second score line 66 extending from said first line to the bottom edge of said skirt, and a tear tab 67 depending below said bottom-most edge vicinal said second score-line.

7. The combination according to claim 6 in which said first line 57 slants downward-inward.

8. The combination according to claim 6 in which the portion of said skirt vicinal said tear tab is offset outward to facilitate gripping said tear tab.

9. The combination of claim 8 in which the interior of said skirt is formed with standoffs bearing against said third shoulder to maintain said portion of said skirt offset outward.

10. The combination of claim 6 in which the lower portion of said skirt below said first horizontal line is substantially vertical and offset outward relative to the portion of said skirt above said first horizontal line.

11. The combination of claim 10 in which a portion of said skirt above said horizontal score line extends outward and comprises a lift tab to lift said cap off said neck after the portion of said skirt below said horizontal score line has been torn off.

12. The combination of claim 1 in which the exterior of the upper end of said cap has a lesser external diameter than the internal diameter of the lower end of said skirt and greater than the internal diameter of said lowermost of said bead means.

13. The combination of claim 12 in which the exterior of the upper end of said cap is formed with substantially vertical ribs.

14. In combination, a container neck formed of a flexible plastic material having a plurality of vertically spaced external locking beads each having an inward directed shoulder on its lower edge and wherein at least one said external locking bead is interrupted and a cap formed of a flexible plastic material having a skirt fitting tightly over said neck, said cap skirt having a corresponding plurality of vertically spaced internal beads adapted to stretch over and thereby engage under said external locking beads, the interruption of said locking bead reducing the force required to stretch said skirt over said locking bead to prevent crushing said neck or splitting said skirt.

15. The combination of claim 14 in which the lowermost of said external locking beads is interrupted.

16. A cap for use with a container neck having a lip 12, at least a first external, downward-outward slanted surface 16 and at least a first 17 and a second 21 horizontal inward-directed shoulder below said first slanted surface;

said cap having a top disk 42 dimensioned to overlie said lip and having a downward-outward slanted skirt depending from said disk, said skirt having an internal shape generally complementary to the exterior of said neck, said skirt having a first internal downward-outward slanted surface 47 adapted to be opposite said first external downward-outward slanted surface 16, said first internal slanted surface being formed with a circumferential internal rib 49 positioned to seal against said first external slanted surface 47 and first 48 and second 52 internal bead means positioned to lock under said first 17 and second 21 shoulders of said neck to hold said cap on said neck, said skirt being formed with tear means to tear off the lower portion of said skirt below said second bead means.

17. A cap according to claim 16 for use with said neck formed above said first horizontal inward-directed shoulder 17 with an upward-inward slanted external surface 13, wherein the interior of said cap is formed above said first cap shoulder 48 with an upward-inward slanted internal surface 43 formed with a circumferential internal rib 46 positioned to seal against said last-mentioned slanted external surface 13.

18. A cap according to claim 7 in which said tear means comprises a first horizontal tear line below said second bead means, a second score line extending from said first tear line to the bottom edge of said skirt, and a tear tab depending below said bottom edge vicinal said second scoreline.

19. A cap according to claim 18 in which the portion of said skirt vicinal said tear tab is offset outward to facilitate gripping said tear tab.

20. A cap according to claim 19 in which the interior of said skirt is formed with standoffs positioned to bear against said third shoulder to maintain said portion of said skirt offset outward.

21. A cap according to claim 18 in which said horizontal tear line slants downward-inward.

22. A cap according to claim 16 in which the lower portion of said skirt below said horizontal tear line is substantially vertical and offset outward relative to the portion of said skirt above said horizontal tear line.

23. A cap according to claim 22 in which a portion of said skirt above said horizontal score line extends outward and comprises a lift tab to lift said cap off said neck after the portion of said skirt below said horizontal score line has been torn off.

24. A cap according to claim 16 in which the exterior of the upper end of said cap has a lesser external diameter than the internal diameter of the lower end of said skirt and greater than the internal diameter of said lowermost of said bead means.

25. A cap according to claim 24 in which the exterior of the upper end of said cap is formed with substantially vertical ribs.

26. A cap according to claim 24 in which the exterior of one said cap is dimensioned to inhibit nesting inside the interior of a superimposed cap.

* * * * *